US007924122B2

(12) United States Patent
Chou et al.

(10) Patent No.: US 7,924,122 B2
(45) Date of Patent: Apr. 12, 2011

(54) COLLAPSIBLE CONTACT SWITCH

(75) Inventors: Tsung-Kuan Allen Chou, San Jose, CA (US); Hanan Bar, Jerusalem (IL)

(73) Assignee: Intel Corporation, Santa Clara, CA (US)

( * ) Notice: Subject to any disclaimer, the term of this patent is extended or adjusted under 35 U.S.C. 154(b) by 8 days.

(21) Appl. No.: 12/497,889

(22) Filed: Jul. 6, 2009

(65) Prior Publication Data

US 2009/0266688 A1 Oct. 29, 2009

Related U.S. Application Data

(63) Continuation of application No. 11/819,373, filed on Jun. 27, 2007, now Pat. No. 7,705,699, which is a continuation of application No. 10/812,900, filed on Mar. 31, 2004, now Pat. No. 7,362,199.

(51) Int. Cl.
*H01H 51/22* (2006.01)

(52) U.S. Cl. ..... 335/78; 200/181

(58) Field of Classification Search ..... 335/78; 200/181
See application file for complete search history.

(56) References Cited

U.S. PATENT DOCUMENTS

| | | | | |
|---|---|---|---|---|
| 6,115,231 | A * | 9/2000 | Shirakawa | 361/233 |
| 6,307,169 | B1 * | 10/2001 | Sun et al. | 200/181 |
| 6,657,525 | B1 * | 12/2003 | Dickens et al. | 335/78 |
| 6,842,097 | B2 * | 1/2005 | Hsu et al. | 335/78 |
| 6,876,482 | B2 * | 4/2005 | DeReus | 359/290 |
| 7,242,273 | B2 * | 7/2007 | Isobe et al. | 335/78 |

* cited by examiner

*Primary Examiner* — Elvin G Enad
*Assistant Examiner* — Bernard Rojas
(74) *Attorney, Agent, or Firm* — Pearl Cohen Zedek Latzer, LLP

(57) ABSTRACT

Embodiments of the invention describe a contact switch, which may include a bottom electrode structure including a bottom actuation electrode and a top electrode structure including a top actuation electrode and one or more stoppers able to maintain a predetermined gap between the top electrode and the bottom electrode when the switch is in a collapsed state.

10 Claims, 10 Drawing Sheets

COLLAPSIBLE CONTACT SWITCH

CROSS-REFERENCE TO RELATED APPLICATIONS

This application is a continuation of U.S. patent application Ser. No. 11/819,373, filed Jun. 27, 2007 now U.S. Pat. No. 7,705,699, which in turn is a continuation of U.S. patent application Ser. No. 10/812,900, filed Mar. 31, 2004 now U.S. Pat. No. 7,362,199, each of which is hereby incorporated by reference.

BACKGROUND OF THE INVENTION

Radio Frequency (RF) switches are widely used in mobile phones and other portable communication devices. They are used to switch communication between transmit and receive modes as well as for switching between ranges of frequencies in multi mode/band radios. They also may be integrated into tunable filters, transceivers, phase shifters and smart antennas. The level of insertion loss of a RF switch directly affects the range and battery life of any device using the switch, for example, cell phones, wireless local area networks, and broadband wireless access devices.

Traditional solid-state RF switches, such as GaAs FETS and PIN diodes that are controlled electronically, often suffer from high insertion loss. Micro-Electro-Mechanical System (MEMS) based RF switches may offer operation at a lower insertion loss.

A desirable feature in a MEMS switch is a high contact force, e.g., larger than 200 μN, in order to achieve low contact resistance, and thus the ability to pass more current through the switch for higher power handling capability. Electrostatic actuation is widely used in applications that require a high switching speed, e.g., on the order of 10 μs or less. Conventional switches generally require an actuation voltage of more than 60 Volts (V) in order to obtain a contact force on the order of 200 μN. Trying to achieve such high contact forces in a conventional switch at lower actuation voltages, e.g., on the order of 20V, would result in high power consumption and may damage a contact point of the switch, thereby shortening the effective lifetime of the switch.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings in which:

Figure 1:
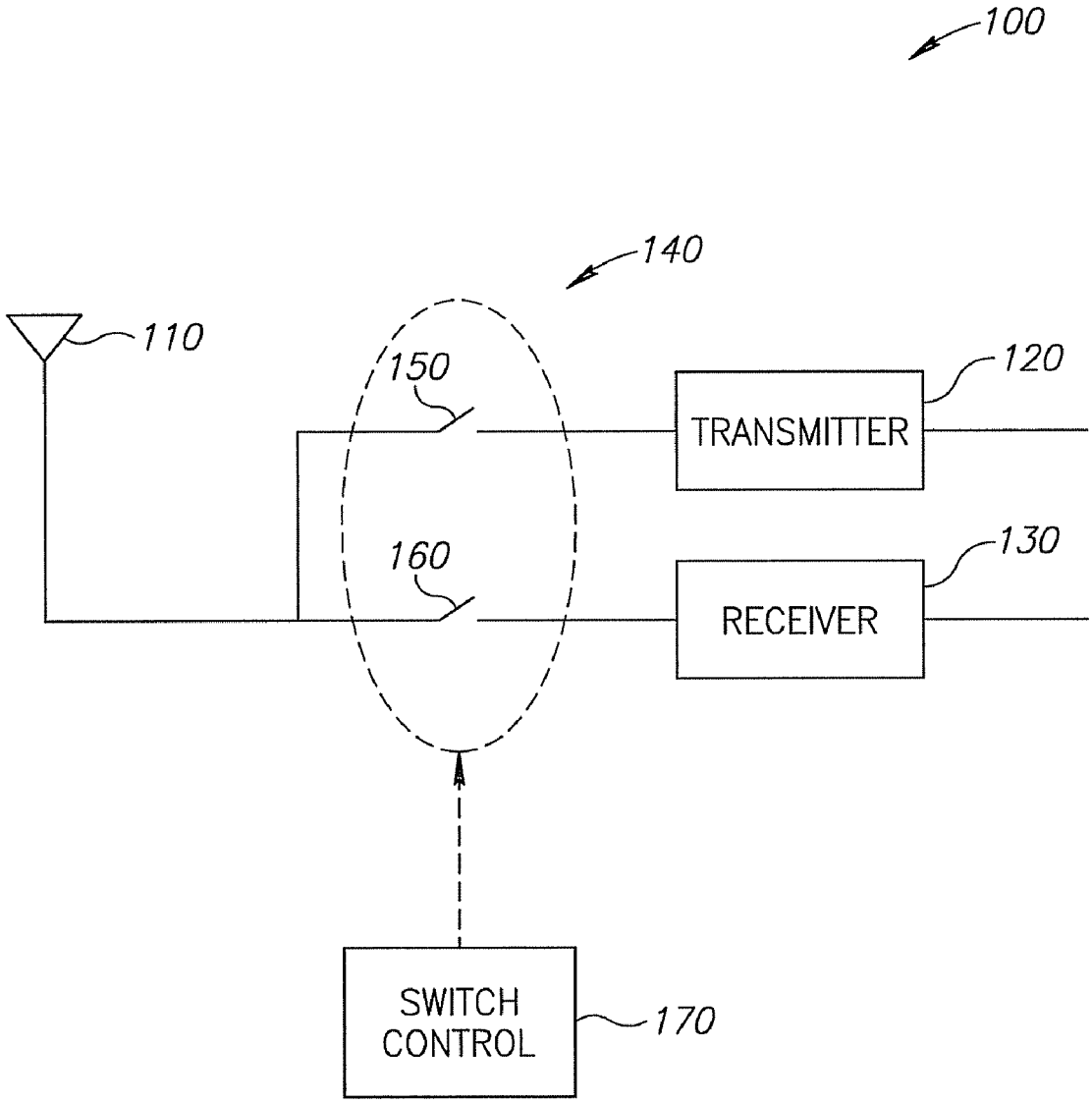
FIG. 1 is a schematic illustration of part of a communication device incorporating a switching arrangement including one or more switches in accordance with exemplary embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF EMBODIMENTS OF THE INVENTION

In the following detailed description, numerous specific details are set forth in order to provide a thorough understanding of the invention. However it will be understood by those of ordinary skill in the art that the present invention may be practiced without these specific details. In other instances, well-known methods, procedures, components and circuits have not been described in detail so as not to obscure the present invention.

It should be understood that the present invention may be used in a variety of applications. Although the present invention is not limited in this respect, the MEMS devices and techniques disclosed herein may be used in many apparatuses such as radios, mobile communication devices, multi mode/band radios, tunable filters, transceivers, phase shifters and smart antennas. Systems intended to be included within the scope of the present invention include, by way of example only, wireless communication stations and wireless local area networks.

Although the present invention is not limited in this respect, the MEMS devices and techniques disclosed herein may be used in any other applications, e.g., DC relays, which may be used, for example, in an automotive system.

It will be appreciated that the terms "top" and "bottom" may be used herein for exemplary purposes only, to illustrate the relative positioning or placement of certain components, and/or to indicate a first and a second component. The terms "top" and "bottom" as used herein do not necessarily indicate that a "top" component is above a "bottom" component, as such directions and/or components may be flipped, rotated, moved in space, placed in a diagonal orientation or position, placed horizontally or vertically, or similarly modified.

FIG. 1 schematically illustrates a front end of a communication device 100 incorporating a switching arrangement 140 according to exemplary embodiments of the invention. Device 100 may include an antenna 110 to send and receive signals. Although the scope of the present invention is not limited in this respect, types of antennae that may be used for antenna 110 may include but are not limited to internal antenna, dipole antenna, omni-directional antenna, a monopole antenna, an end fed antenna, a circularly polarized antenna, a micro-strip antenna, a diversity antenna and the like. Switching arrangement 140 may selectively connect antenna 110 either to a transmitter 120, which may produce signals to be transmitted by antenna 110, or to a receiver 130, which may process signals received by antenna 110.

Arrangement 140 may include switches 150 and 160 to selectively connect antenna 110 to transmitter 120 and receiver 130, respectively. Device 100 may also include a switch controller 170 able to control the operation of switch 150 and/or switch 160, e.g., to toggle the connection to antenna 110 between transmitter 120 and 130. Either or both of switches 150 and 160 may include an electrostatic collapsible contact switch according to exemplary embodiments of the invention, as described in detail below, which allows toggling the connection to antenna 110 between transmitter 120 and 130 at a high rate. As described in detail below, the structure of switches 150 and 160 enables operation of the switches at relatively low voltages, low power consumption and/or large contact forces, all of which may result in an extend lifetime of switches 150 and 160.

It will be appreciated by persons skilled in the art that the above description of a communication device having a shared transmit/receive antenna is merely one example of a device incorporating collapsible switches according to embodiments of the present invention. It will be further appreciated that any type of device, system or method using such collapsible switches is also within the scope the present invention.

Figure 2A:
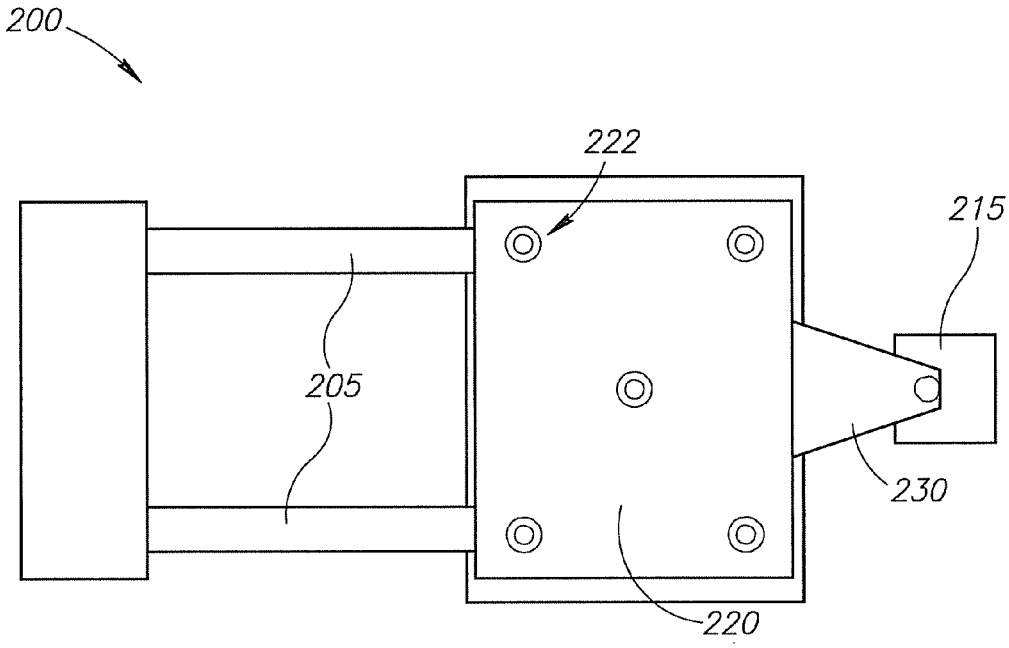
FIG. 2A is a schematic, top view, illustration of a contact switch according to an exemplary embodiment of the invention.

Turning to FIGS. 2A-2E, schematic illustrations of a switch 200 according to an exemplary embodiment of the present invention are shown. FIG. 2A shows a top view and FIGS. 2B-2E show cross-sectional side views of switch 200 at four, respective, operational positions. Although the scope of the present invention is not limited in this respect, a top layer 250 of switch 200 may consist of three sections: at least one support beam 205, that may have a low spring constant, k, for example, between 50 N/m and 150 N/m; a top electrode 220, that may be relatively large and rigid; and a contact beam 230, that may have a high spring constant, k, for example, between 5000 N/m and 15000 N/m. One or more stoppers 222 may be disposed underneath top electrode 220, and a top electrical contact, e.g., a contact dimple 232, may be disposed underneath the contact beam 230. One or more electrically isolated islands 212 may be disposed on a bottom electrode 210, e.g., directly underneath top layer stoppers 222, and a bottom electrical contact, e.g., a contact metal 215, may be disposed on bottom electrode 210 underneath contact dimple 232.

It will be appreciated that top electrode 220 and stoppers 222 may be collectively referred to herein as a "top electrode structure" and may be implemented, for example, in the form of a single element incorporating the structure and functionality of both electrode 220 and stoppers 222. Furthermore, bottom electrode 210 and islands 212 may be collectively referred to herein as a "bottom electrode structure" and may be implemented, for example, in the form of a single element incorporating the structure and functionality of both electrode 210 and islands 212.

Figure 2B:
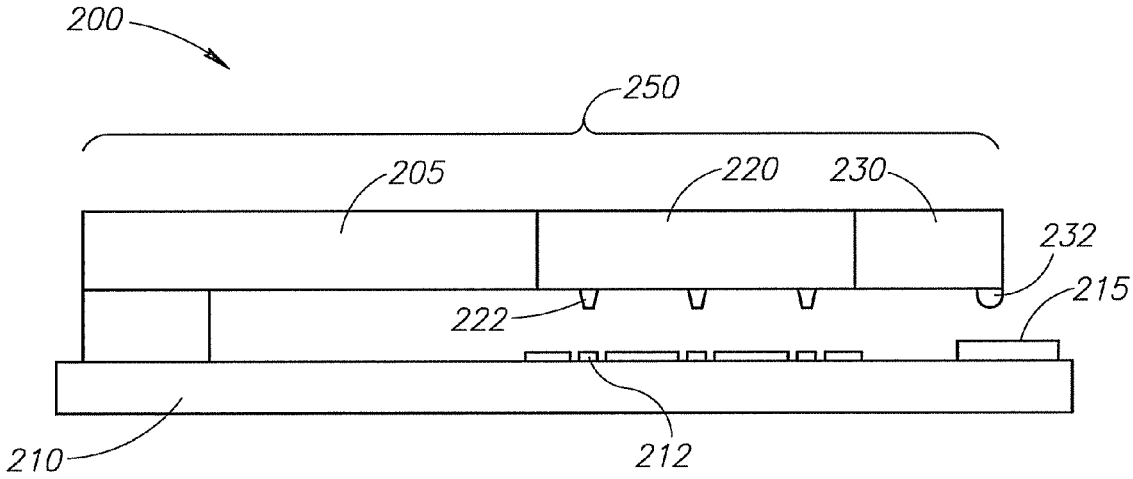
FIGS. 2B, 2C, 2D and 2E are schematic, side view, cross-sectional, illustrations of the contact switch according to the exemplary embodiment of FIG. 2A at four, respective, operational positions.

As discussed below, the exemplary switch design illustrated in FIGS. 2A and 2B may allow deflection of beam 205 in response to a relatively low actuation voltage applied between the top electrode 220 and the bottom electrode 210, resulting in a high contact force between contact dimple 232 and contact metal 215.

Figure 2C:
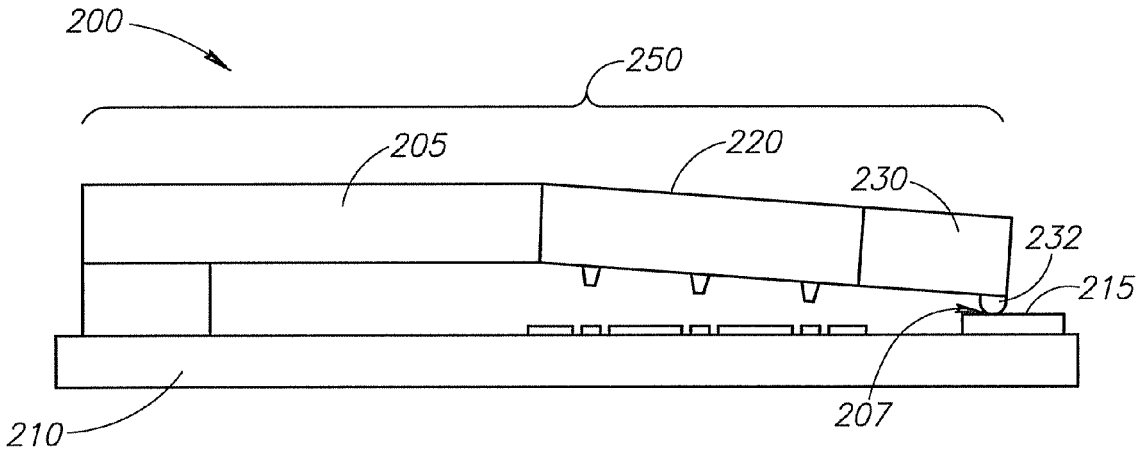
Figure 2D:
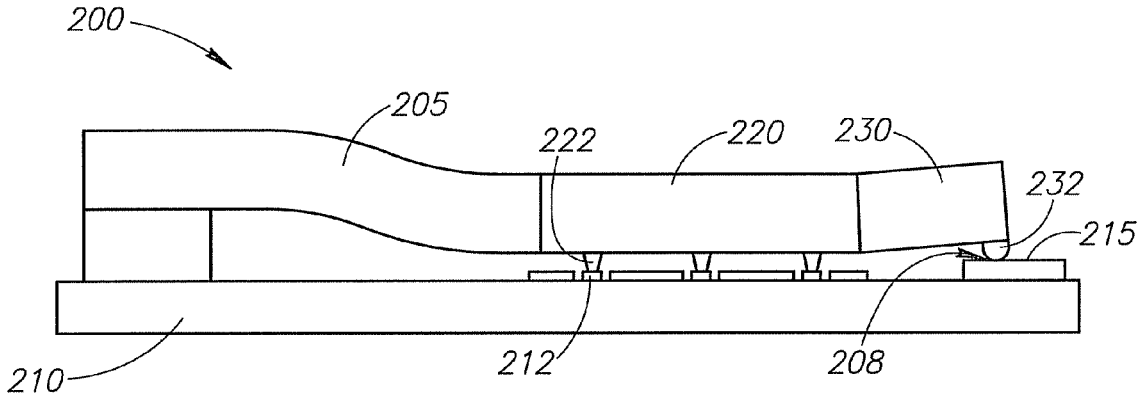

FIG. 2C and FIG. 2D show cross-sectional side views of exemplary switch 200 in response to a relatively low actuation voltage. FIG. 2C illustrates how top electrode 220 may be pulled in towards bottom electrode 210 in response to a relatively low actuation voltage, for example, the voltages shown in the schematic comparative graph of FIG. 4 below. The low spring constant beam, 205, may bear substantially all the deflection force until contact dimple 232 makes contact with contact metal 215 at a point 207. FIG. 2D shows how under continuing application of the relatively low actuation voltage, switch 200 may collapse through a strong downward deflection of low spring constant beam 205 and a slight upward deflection of contact beam 230. By virtue of stoppers 222 and electrically isolated islands 212, a desired gap, for example 0.1 μm, although the invention is in no way limited by this example may be maintained between top electrode 210 and bottom electrode 220. The deflection of contact beam 230 may result in a high contact force between contact dimple 232 and contact metal 215. A final point of contact 208 between dimple 232 and metal 215 may be displaced slightly from point 207 where initial contact was made, due to the final deflection of contact beam 230 in the fully collapsed state.

It should be noted that the deflection of contact beam 230 may result in a large contact force, and the displacement of the contact from point 207 to point 208 may result in a high probability of contact dimple 232 penetrating a surface contamination layer (not shown) that may develop over time on contact metal 215 and/or contact dimple 232. These two effects may result in a highly reliable switch that is able to maintain high current transfer characteristics and long contact lifetime. According to exemplary embodiments of the invention, stoppers 222 and electrically isolated islands 212 maintain the air gap between the top and bottom electrodes, 220 and 210, respectively, and this air gap may eliminate dielectric charging between the electrodes, a problem often encountered in conventional collapsing switches.

Figure 2E:
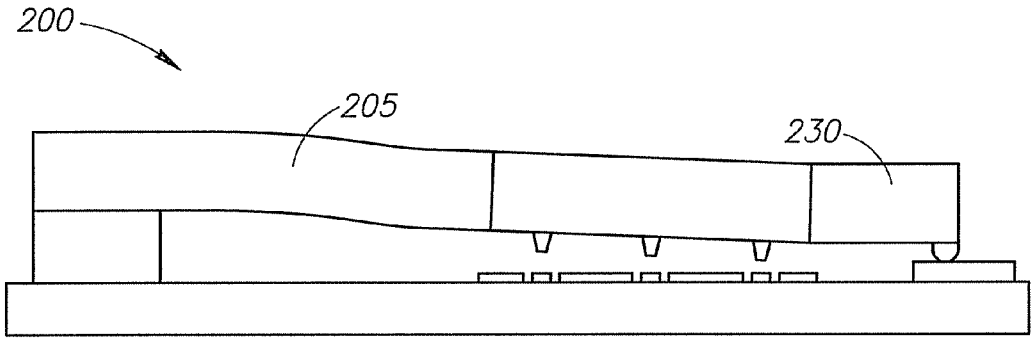

In FIG. 2E, a cross-sectional side view of exemplary switch 200 is shown after the collapse of the switch and after the low actuation voltage is removed. Removal of the actuation voltage may cause the top layer 250 of switch 200 to be detached from the bottom electrode 210 of switch 200 due to relaxing of the deflection force in both beam 205 and beam 230.

It should be noted that, since there are only a few physical contact points between the top layer 250 and bottom electrode 210, switch 200 may be switched open with a "zipping" action and with a relatively low stiction effect, e.g., due to electric charging or physical contact. Furthermore, since physical stoppers 222 retain air gap between electrodes 210 and 220, it is expected that the device will experience less air damping and, thus, the resulting opening speed may be relatively high.

Turning to FIG. 3, another exemplary embodiment of a switch 300 according to the present invention is shown. Although the scope of the present invention is not limited in this respect, the architecture and operation of the switch illustrated in FIG. 3 may be generally similar to those of the switch illustrated in FIG. 2, except for the differences described below. The design shown in the exemplary embodiment of FIG. 3 is generally identical to that of FIG. 2, except that switch 300 of FIG. 3 does not include electrically isolated islands directly underneath stoppers 322, as in switch 200 of FIG. 2. This difference is shown clearly by the cross-sectional side view in FIG. 3B. Switch 300 includes support beam 305, contact beam 330, metal 315, stoppers 322 and contact dimple 332. The absence of electrically isolated islands may result in a narrow air gap between the top and bottom electrodes 320 and 310 respectively, when switch 300 is in its collapsed state, as stoppers 322 bear down directly on bottom electrode 310.

Figure 3A:
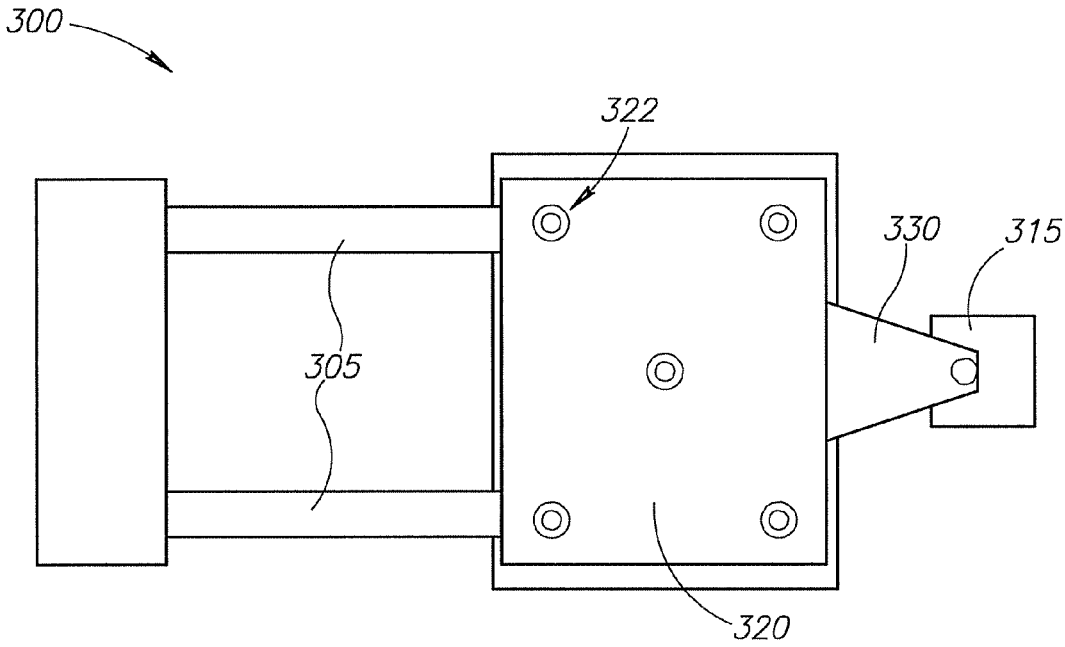
FIG. 3A is a schematic, top view, illustration of a contact switch according to another exemplary embodiment of the invention.
Figure 3B:
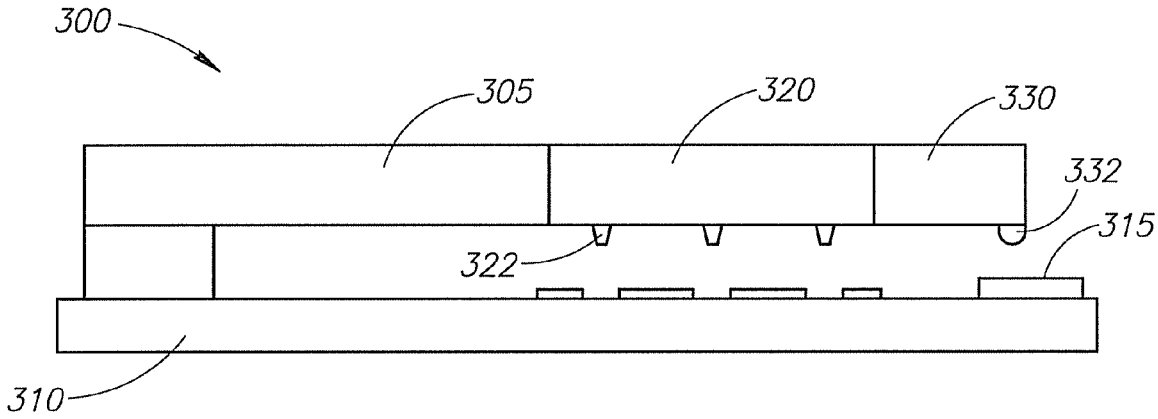
FIGS. 3B, 3C, 3D and 3E are schematic, side view, cross-sectional, illustrations of the contact switch according to the exemplary embodiment of FIG. 3A at four, respective, operational positions.
Figure 3C:
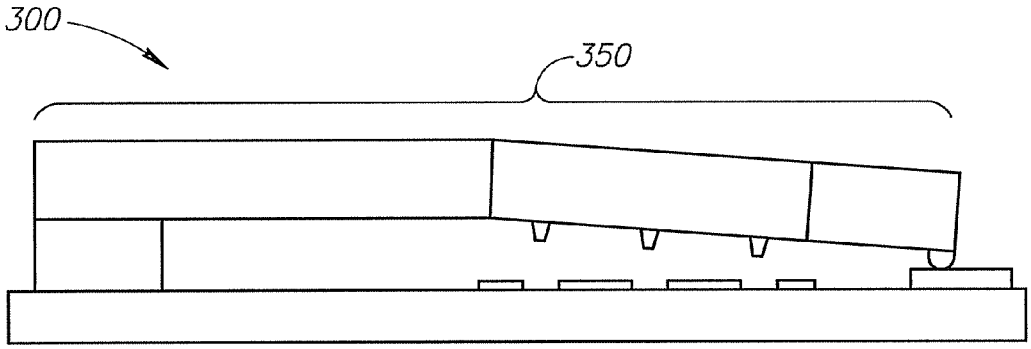
Figure 3D:
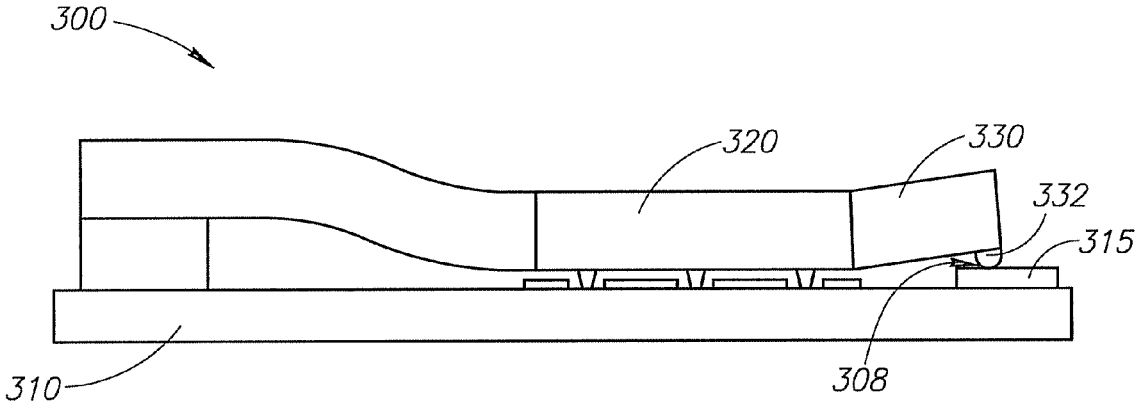

In FIG. 3C and FIG. 3D cross-sectional side views of the exemplary switch are shown in response to a relatively low actuation voltage. FIG. 3C illustrates the initial deflection and FIG. 3D the collapse of the switch in a manner analogous to those described above with reference to FIG. 2C and FIG. 2D, respectively. Although the scope of the present invention is not limited in this respect, the deflection and collapse of the switch illustrated in FIG. 3 may be generally similar to those illustrated in FIG. 2, except for the resulting gap between top and bottom electrodes 320 and 310, respectively. The absence of electrically isolated islands may result in a smaller gap and, thus, in a different final contact point 308 and a different contact force between contact dimple 332 and contact metal 315, which force may be larger than the contact force encountered in switch 200 of FIG. 2.

Figure 3E:
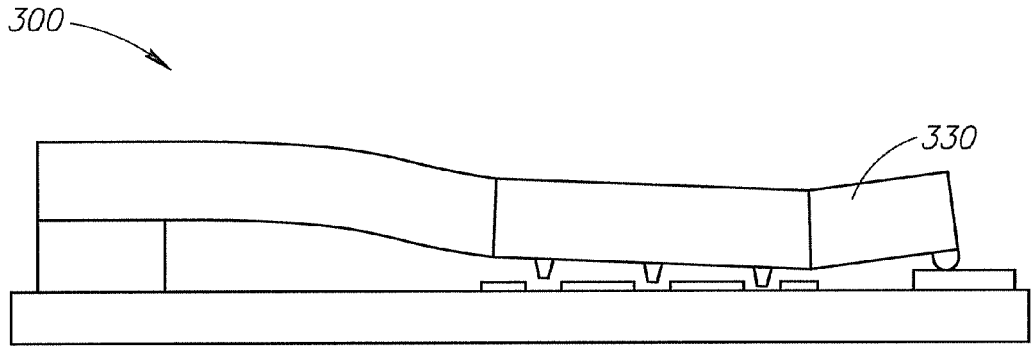

In FIG. 3E a cross-sectional side view of the exemplary switch is shown after the collapse of the switch and after the actuation voltage is removed. Although the scope of the present invention is not limited in this respect, the detachment of top layer 350 from bottom electrode 310 shown in FIG. 3E may be similar to that shown in FIG. 2E except for the differences discussed below. The absence of electrically isolated islands, that may result in a smaller gap between top and bottom electrodes 320 and 310, respectively, when switch 300 in is in its collapsed state, may result in a stronger deflection of the high spring-constant contact beam 330 and, thus, in faster detachment of contact beam 330 once the actuation voltage is removed.

Figure 4:
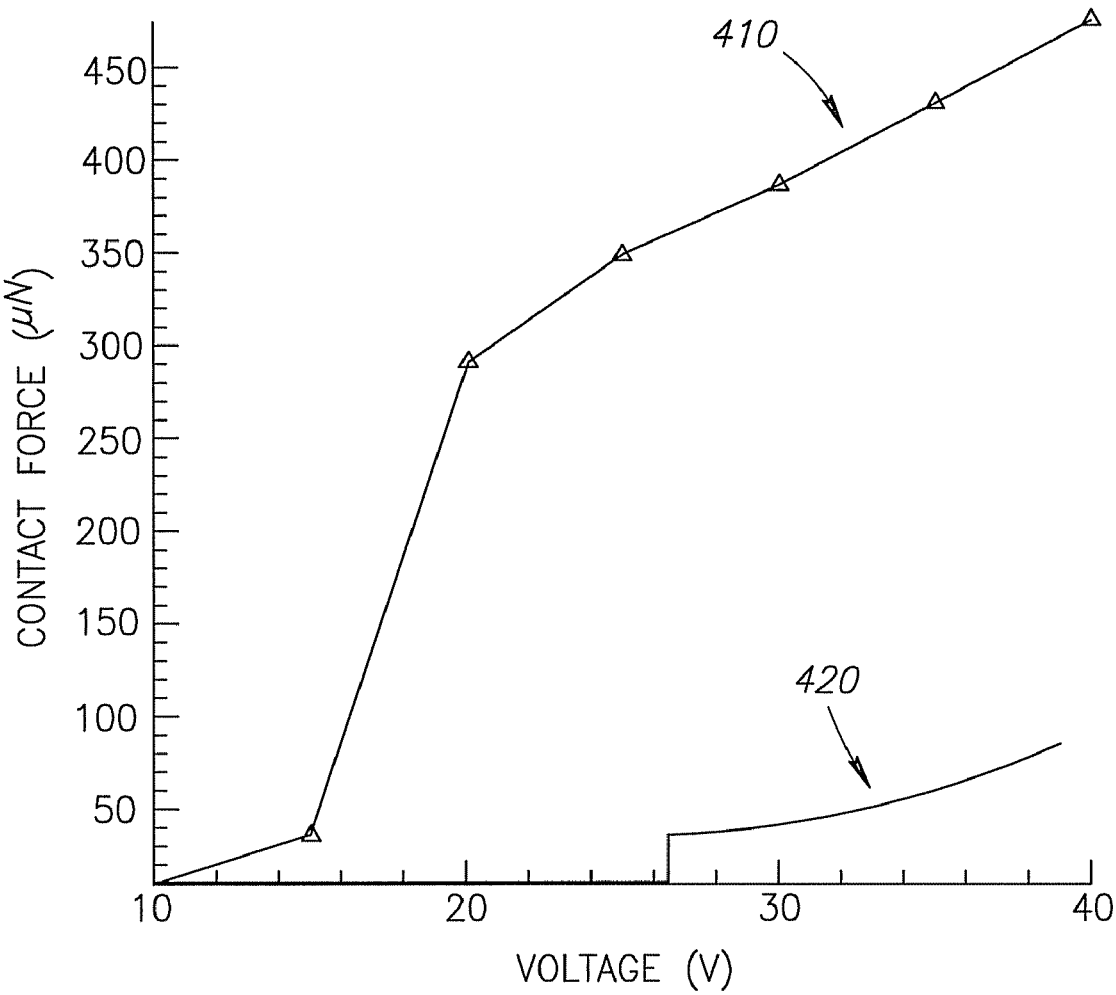
FIG. 4 is a schematic illustration of a graph depicting contact force as a function of applied voltage of a simulated switch according to an exemplary embodiment of the invention.

Turning to FIG. 4, a schematic illustration of a graph depicting contact force as a function of applied voltage of a simulated collapsed switch according to an exemplary embodiment of the invention is shown. A top curve 410 in FIG. 4 shows the contact force between the top and bottom contact points of a simulated switch designed according to an exemplary embodiment of the present invention, for example, of the type shown in FIG. 2. The contact force is shown for the collapsed switch state at different actuation voltages. Curve 410 clearly shows a relatively high contact force even for very low actuation voltages, e.g., 300 μN for an actuation voltage of 20V. A lower curve 420 in FIG. 4 shows the contact force expected from a conventional pull-in contact switch. A comparison between curves 410 and 420 clearly shows a significantly lower contact force for the conventional switch at significantly higher actuation voltages.

Figure 5A:
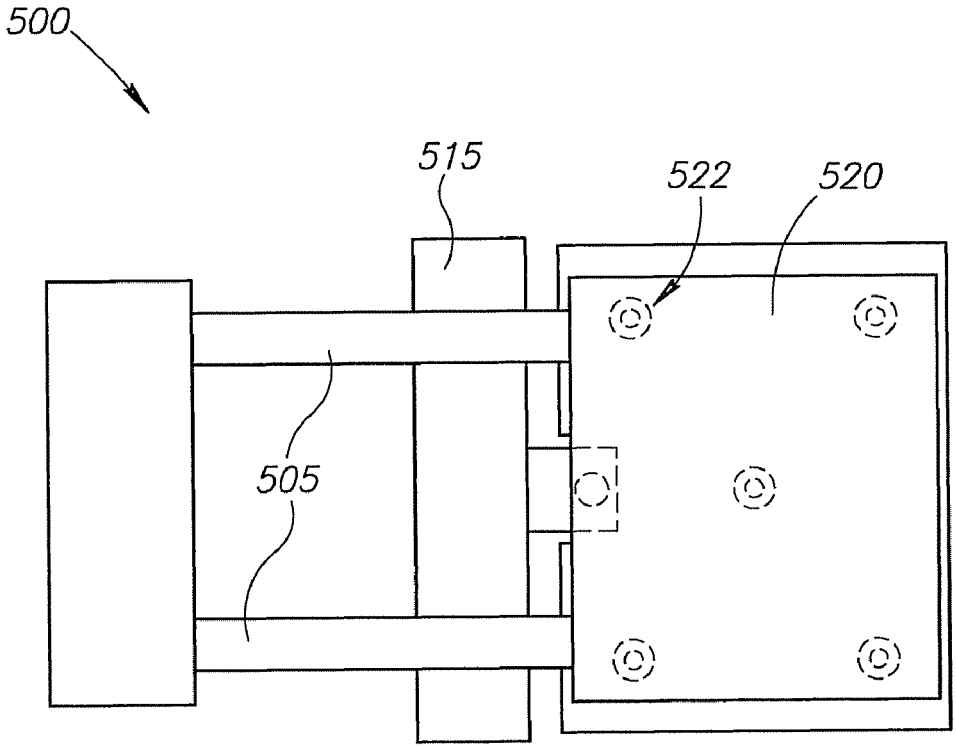
FIG. 5A is a schematic, top view, illustration of a switch according to another exemplary embodiment of the invention.
Figure 5B:
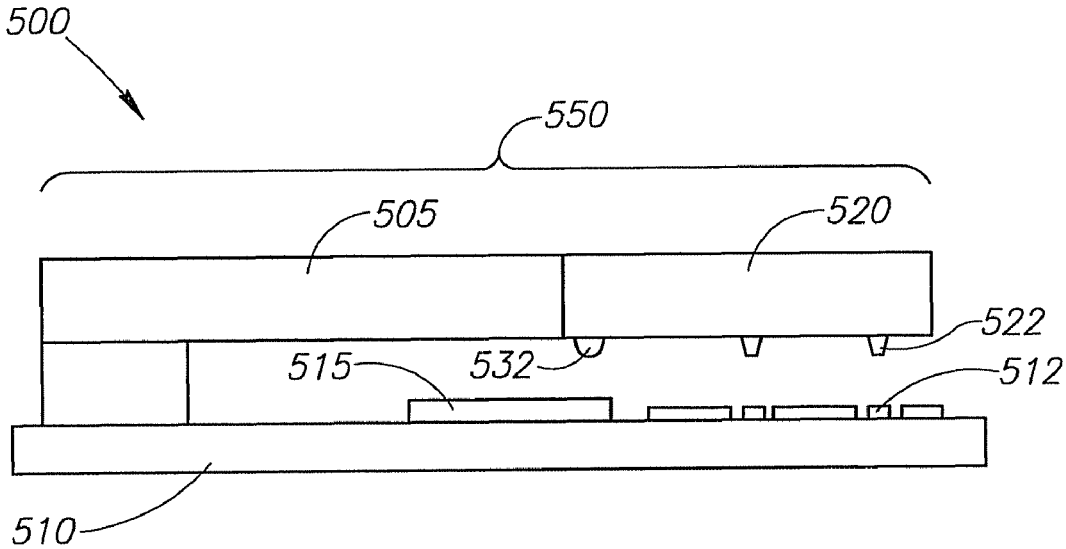
FIG. 5B is a schematic, cross-sectional side view illustration of the switch according to the exemplary embodiment of FIG. 5A.

Turning to FIGS. 5A and 5B, schematic illustrations of a switch 500 according to another exemplary embodiment of the present invention is shown. FIG. 5A shows a top view and FIG. 5B shows a cross-sectional side view of switch 500. Although the scope of the present invention is not limited in this respect, the architecture and operation of the switch illustrated in FIG. 5 may be generally similar to those of the switch illustrated in FIG. 2, except for the differences described below. A top layer 550 of the switch shown in FIG. 5 may consist of two parts: at least one support beam 505 having a low spring constant k, and a relatively large and rigid top electrode 520. A contact dimple 532 may be disposed under the top electrode 520, e.g., near the seam between low k beam 505 and electrode 520, directly above a bottom contact metal 515, that may be disposed on the bottom actuation electrode 510. Electrically isolated islands 512 may be disposed on a bottom electrode 510, and may be positioned directly underneath stoppers 522, which may be disposed below the top electrode 520.

The operation of the switch illustrated in FIG. 5 is generally similar to that of the switch of FIG. 2. An actuation voltage applied between top electrode 520 and bottom electrode 510 may result in deflection of low k beam 505 and collapse of switch 500 that may result in contact between contact dimple 532 and contact metal 515. The size of the gap between top and bottom electrodes 520 and 510, in the collapsed state, as well as the strength of the contact between contact dimple 532 and contact metal 515, may be affected by the size of stoppers 522 and islands 512. The position of the contact dimple 532 to the left of the stoppers 522 may affect a non-linear deflection of the low spring constant beam 505 resulting in an opening force, once actuation voltage is removed, that may be higher than in the exemplary embodiments shown in FIG. 2 and FIG. 3, for example, an opening force of about 100 μN. This may result in faster opening of top electrode 510 from bottom electrode 520 and, thus, improved opening performance of the switch.

Figure 6A:
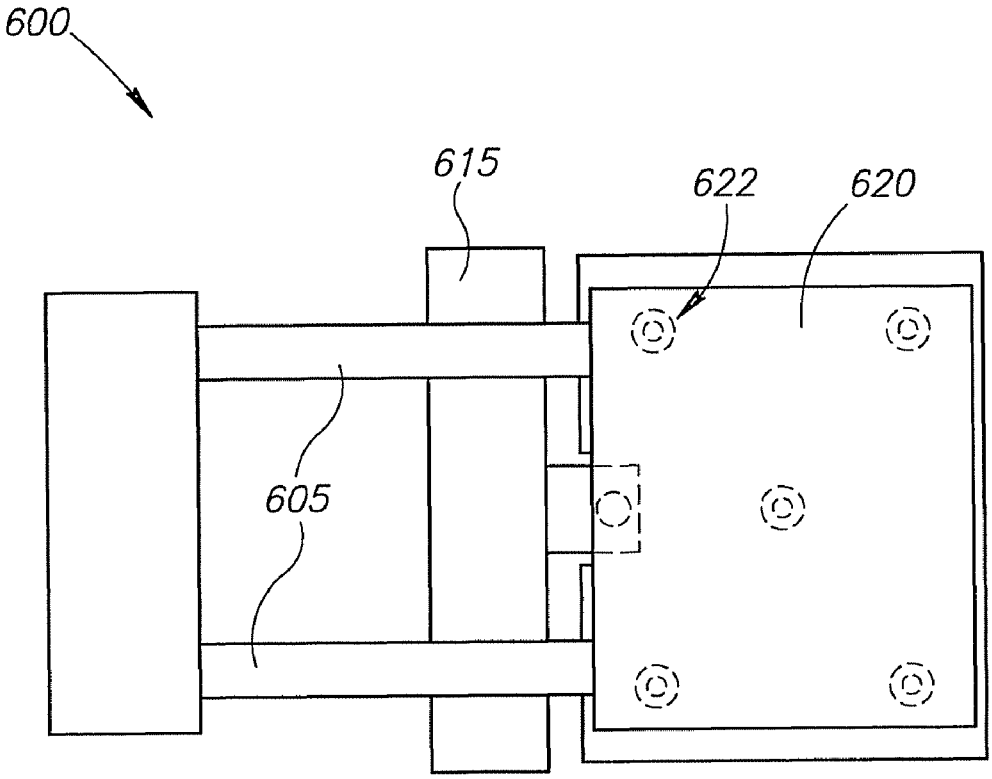
FIG. 6A is a schematic, top view, illustration of a switch according to a further exemplary embodiment of the invention.
Figure 6B:
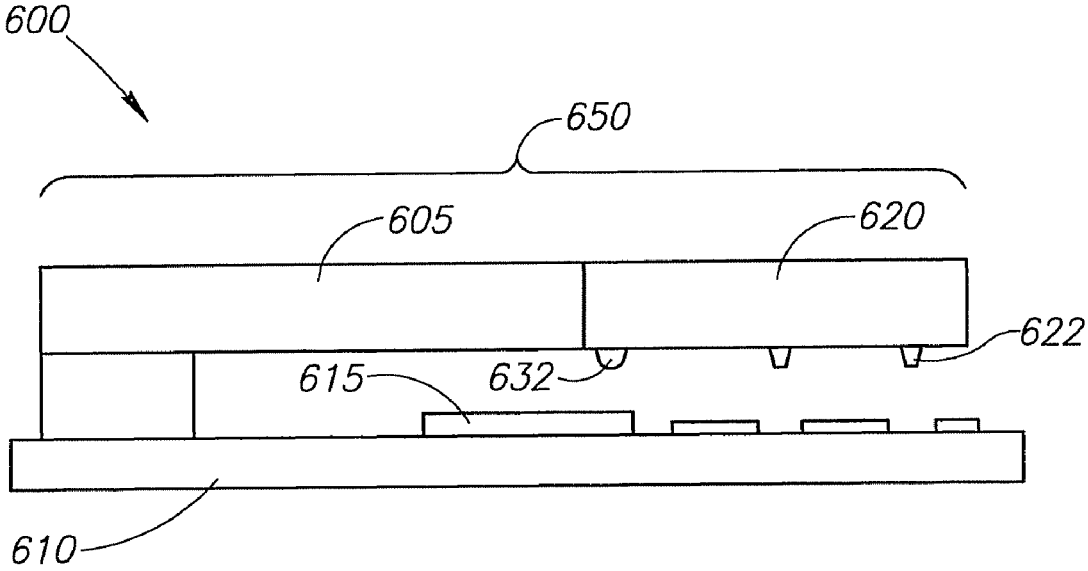
FIG. 6B is a schematic, cross-sectional side view illustration of the switch according to the exemplary embodiment of FIG. 6A.

Turning to FIGS. 6A and 6B, schematic illustrations of a switch 600 according to another exemplary embodiment of the present invention is shown. FIG. 6A shows a top view and FIG. 6B shows a cross-sectional side view of switch 600. Although the scope of the present invention is not limited in this respect, the architecture and operation of the switch illustrated in FIG. 6 may be generally similar to those of the switch illustrated in FIG. 2, except for the differences described below. A top layer 650 of the switch shown in FIG. 6 may consist of two parts: at least one support beam 605 having a low spring constant k and a relatively large and rigid top electrode 620. A contact dimple 632 may be disposed under top electrode 600, e.g., near the seam between low k beam 605 and electrode 620, directly above a bottom contact metal 615, that may be disposed on a bottom actuation electrode 610. Stoppers 622 may be disposed below top electrode 620.

The operation of the switch illustrated in FIG. 6 is generally similar to that of the switch of FIG. 2. An actuation voltage applied between top electrode 620 and bottom electrode 610 may result in deflection of low k beam 605 and collapse of switch 600 that may result in contact between contact dimple 632 and contact metal 615. The size of the gap between top and bottom electrodes 620 and 610, in the collapsed state, as well as the strength of the contact between contact dimple 632 and contact metal 615, may be affected by the size of the stoppers 622. The position of the contact dimple 632 to the left of the stoppers 622 may effect a non-linear deflection of the low spring constant beam 605 resulting in an opening force, once actuation voltage is removed, that may be higher than in the exemplary embodiments shown in FIG. 2 and FIG. 3, for example, an opening force of about 120□N. This may result in faster opening of top electrode 610 from bottom electrode 620 and, thus, improved opening performance of the switch.

Figure 7A:
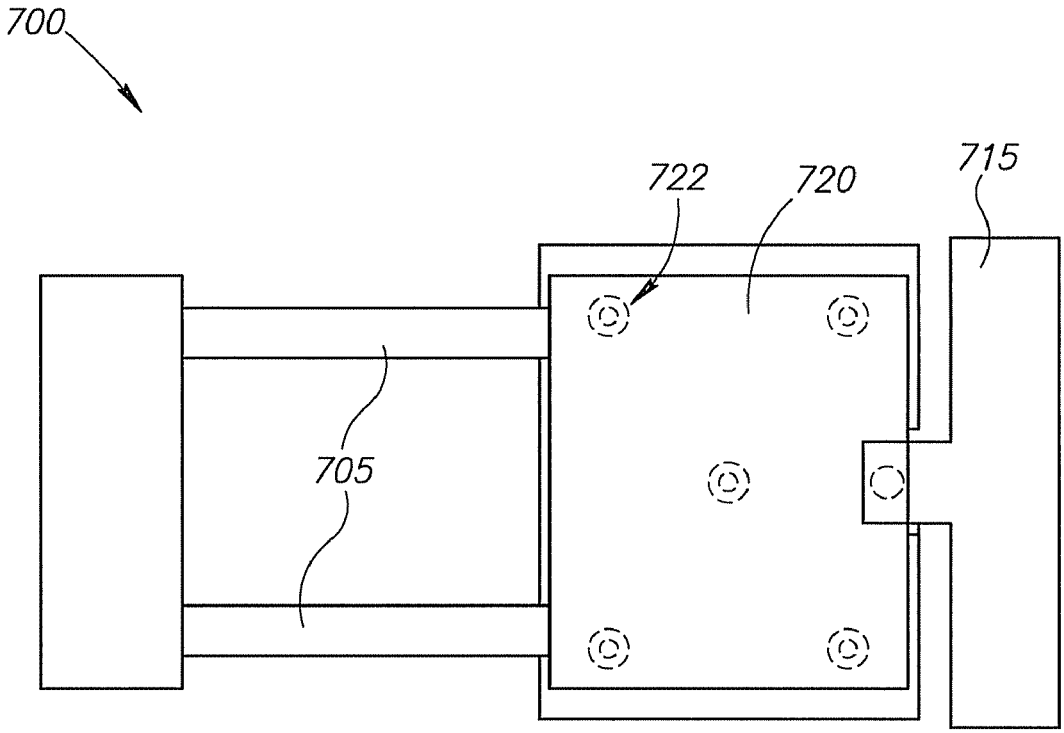
FIG. 7A is a schematic, top view, illustration of a switch according to an additional exemplary embodiment of the invention.
Figure 7B:
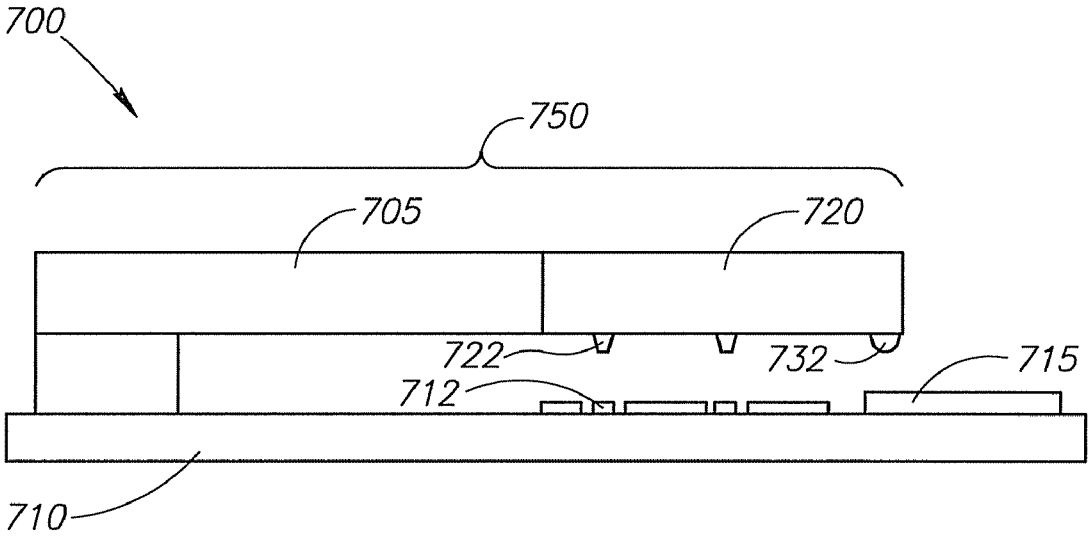
FIG. 7B is a schematic, cross-sectional side view illustration of the switch according to the exemplary embodiment of FIG. 7A

Turning to FIGS. 7A and 7B, schematic illustrations of a switch 700 according to another exemplary embodiment of the present invention is shown. FIG. 7A shows a top view and FIG. 7B shows a cross-sectional side view of switch 700. Although the scope of the present invention is not limited in this respect, the architecture and operation of the switch illustrated in FIG. 7 may be generally similar to those of the switch illustrated in FIG. 2, except for the differences described below. A top layer 750 of the switch shown in FIG. 7 may consist of two parts: a support beam 705 having a low spring constant k and a relatively large and rigid top electrode 720. A contact dimple 732 may be disposed under the top electrode 720, e.g., near the edge of the electrode, directly above a bottom contact metal 715, that may be disposed on a bottom actuation electrode 710. Electrically isolated islands 712 may be disposed on the bottom electrode 710, and may be positioned directly underneath stoppers 722, which may be disposed below top electrode 720.

The operation of the switch illustrated in FIG. 7 is generally similar to that of the switch of FIG. 2. An actuation voltage applied between a top electrode 720 and a bottom electrode 710 may result in deflection of a low k beam 705 and collapse of switch 700 that may result in contact between contact dimple 732 and contact metal 715. The size of the gap between top and bottom electrodes 720 and 710, in the collapsed state, as well as the strength of the contact between contact dimple 732 and contact metal 715, may be affected by the size of the stoppers 722 and islands 712.

Figure 8A:
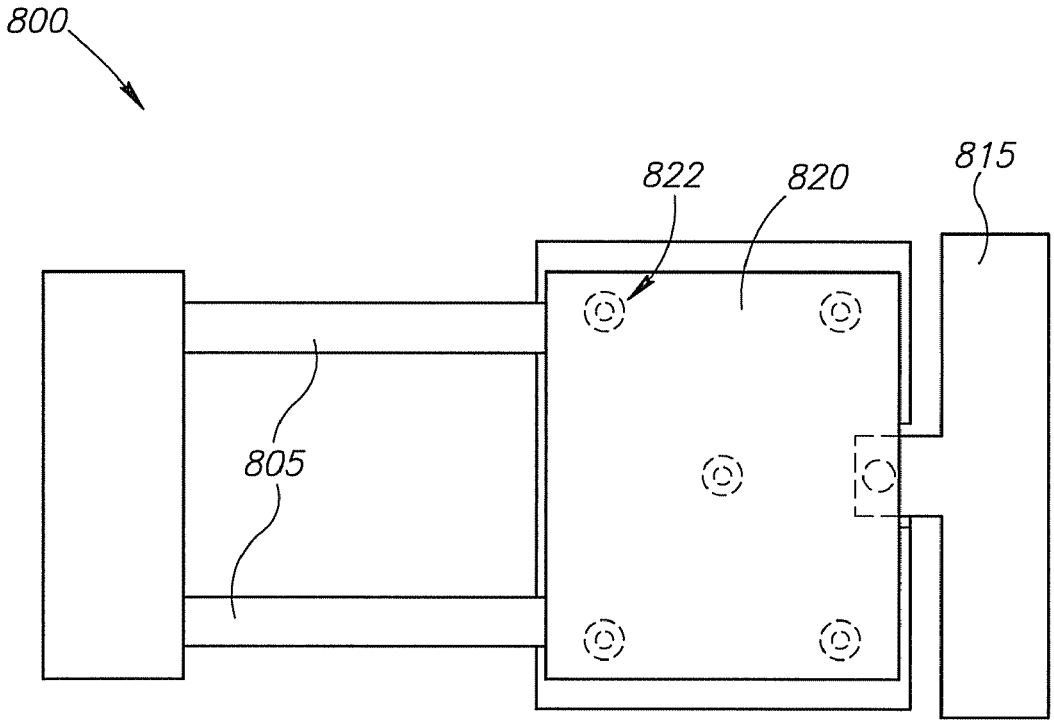
FIG. 8A is a schematic, top view, illustration of a switch according to yet another exemplary embodiment of the invention.
Figure 8B:
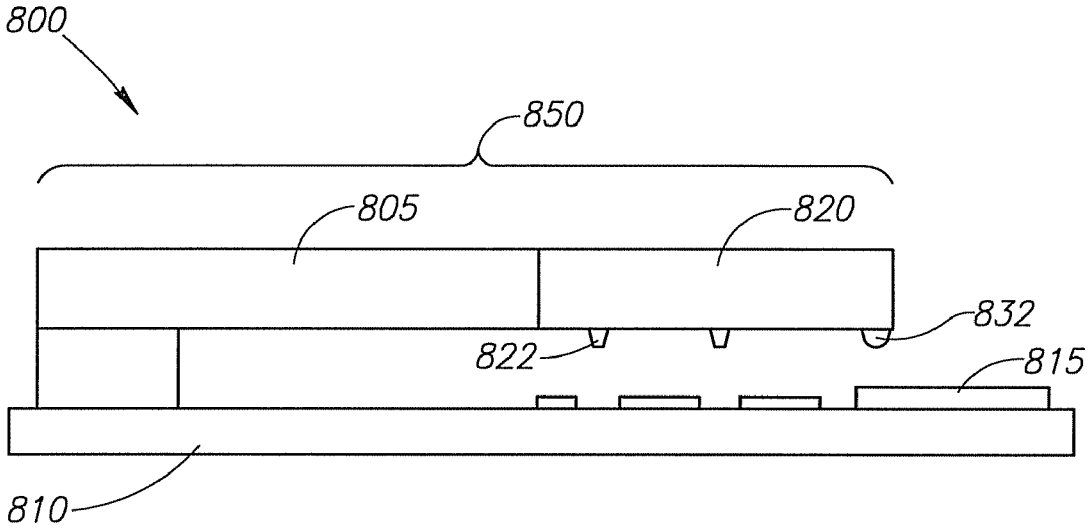
FIG. 8B is a schematic, cross-sectional side view, illustration of the switch according to the exemplary embodiment of FIG. 8A.

Turning to FIGS. 8A and 8B, schematic illustrations of a switch 800 according to another exemplary embodiment of the present invention is shown. FIG. 8A shows a top view and FIG. 8B shows a cross-sectional side view of switch 800. Although the scope of the present invention is not limited in this respect, the architecture and operation of the switch illustrated in FIG. 8 may be generally similar to those of the switch illustrated in FIG. 2, except for the differences described below. A top layer 850 of the switch shown in FIG. 8 may consist of two parts: a support beam 805 having a low spring constant k and a relatively large and rigid top electrode 820. A contact dimple 832 may be disposed under the top electrode 820, e.g., near the edge of the electrode, directly above a bottom contact metal 815, that may be disposed on a bottom actuation electrode 810. Stoppers 822 may be disposed below the top electrode 820.

The operation of the switch illustrated in FIG. 8 is generally similar to that of the switch of FIG. 2. An actuation voltage applied between top electrode 820 and bottom electrode 810 may result in deflection of low k beam 805 and collapse of switch 800 that may result in contact between contact dimple 832 and contact metal 815. The size of the gap between top and bottom electrodes 820 and 810, in the collapsed state, as well as the strength of the contact between contact dimple 832 and contact metal 815, may be affected by the size of the stoppers 822.

It will be appreciated by persons skilled in the art that there may be many additional embodiments and implementations of switches according to the present invention. The above exemplary embodiments merely demonstrate a few possible variations of switches according to embodiments of the invention and are not intended to limit the scope of the invention in any way.

While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

What is claimed is:

1. A micro-electro-mechanical systems switch comprising:

a first electrode having a first contact disposed thereon;

a layer comprising a support beam having a portion operably attached to said first electrode, a second electrode adjacent to said support beam and distal from said attached portion, and a contact beam adjacent to said second electrode and distal from said support beam, wherein said support beam has a low spring constant, said contact beam has a high spring constant, and said second electrode is rigid relative to the support beam and the contact beam; and a second contact disposed on said contact beam, wherein application of an activation voltage between said electrodes causes a contact force between said contacts.

2. The switch of claim 1, wherein said low spring constant is between approximately 50 Newtons per meter and approximately 150 Newtons per meter.

3. The switch of claim 1, wherein said contact force is at least approximately 100 micro-Newtons when said activation voltage is approximately 40 Volts.

4. The switch of claim 1, wherein said high spring constant is between approximately 5,000 Newtons per meter and approximately 15,000 Newtons per meter.

5. The switch of claim 1, comprising a stopper disposed on said second electrode, wherein said stopper creates a gap between said electrodes during application of said activation voltage.

6. The switch of claim 5, comprising an electrically isolated island disposed on said first electrode, wherein application of said activation voltage causes said island to contact said stopper.

7. The switch of claim 1, wherein said layer is deflected by said contact force.

8. The switch of claim 7, wherein removal of said activation voltage causes said contacts to detach from each other due to relaxing of said deflected layer.

9. The switch of claim 7, wherein said contact beam is deflected by said contact force.

10. The switch of claim 7, wherein said support beam is deflected by said contact force.

* * * * *